United States Patent [19]

Ott

[11] Patent Number: 4,577,399

[45] Date of Patent: Mar. 25, 1986

[54] COMMUTATOR PLACING MACHINE

[75] Inventor: Kenneth A. Ott, Ludlow Falls, Ohio

[73] Assignee: Ott-A-Matic, Inc., Vandalia, Ohio

[21] Appl. No.: 614,922

[22] Filed: May 29, 1984

[51] Int. Cl.[4] ..... H01R 43/06

[52] U.S. Cl. ..... 29/733; 29/597

[58] Field of Search ..... 29/597, 732, 733, 759

[56] References Cited

U.S. PATENT DOCUMENTS 1,690,322 11/1928 Baker ..... 29/733

3,624,890 12/1971 Schuette et al. ..... 29/733 X

*Primary Examiner*—Carl E. Hall

*Attorney, Agent, or Firm*—Biebel, French & Nauman

[57] ABSTRACT

A commutator placing machine includes means for feeding armatures to a loading position where they are indexed to a preset angular position, means for feeding commutators to a loading position, and means for orienting the commutators prior to installation onto the armature shaft. An index slide or shuttle is provided to impart a rotational component of force to ensure that the commutator is properly positioned with respect to a locator tab. A proximity sensor indicates when the commutator is in its proper position, and if the commutator is not properly positioned, then the index slide is first retracted and then again extended in an attempt to seat the commutator properly. Guide rails are provided to ensure that the commutator maintains its orientation from its loading position to its final position on the armature shaft.

4 Claims, 15 Drawing Figures

COMMUTATOR PLACING MACHINE

BACKGROUND OF THE INVENTION

This invention relates to a commutator placing machine, and particularly to a method and apparatus for accurately orienting a commutator and maintaining the orientation of that commutator as it is installed on an armature shaft.

A commutator is a device for connecting electrical current from a fixed set of brushes or contacts to the windings of a rotating armature. A commutator typically includes a plurality of evenly spaced conductive strips, usually copper, formed on a cylindrical base of insulating material. One end of each segment is formed into a tang, a hooked member around which the wire from the armature winding is placed to provide electrical contact.

As these strips rotate with the armature, different pairs are connected to the brushes, and the magnetic field set up by current passing through the winding connected to these contacts creates a force causing the armature to rotate. The angular position of the segments as they contact the brushes in relation to the angular position of their corresponding windings in the armature is precisely determined according to the type of motor into which the armature is placed. It is, therefore, essential that the commutator be placed on the armature with these segments accurately located with respect to their corresponding windings if the motor is to operate properly.

In a typical commutator placing machine, commutators are fed one at a time into a loading position. Armatures are also brought into position and properly aligned to receive the commutators. The commutators are oriented by some means and then installed on the armature shaft.

In a typical prior art machine, the angular position of the armature is set according to its designed characteristics. The commutator is first oriented to a fixed angular position and then installed onto the armature shaft. A typical machine would include a set of rails onto which the commutator is directed, and as the commutator started its movement down the rails toward the armature, the tangs on the commutator would become aligned with the rails. Actually, the spaces between the tangs receive the rails.

Occasionally, however, the commutators would not settle onto the rails accurately, and this would cause the commutator either to jam, become broken or be installed on the armature shaft in an inaccurate position. None of the prior art armature placing machines included any means for ensuring that the commutator orientation was correct before it was installed on the armature shaft and means for maintaining that orientation from the commutator loading position to its final seated position on the armature shaft.

It has been found that the opening in the commutator through which the armature shaft extends may not be properly formed or may include some irregularity which would tend to cause the commutator to rotate slightly as it approaches its final seating position on the shaft. Any rotation of the commutator will of course cause misalignment thereof and reduce the efficiency of that motor in which it is installed.

SUMMARY OF THE INVENTION

In accordance with this invention, means are provided to ensure that the commutators are properly oriented prior to any attempt to install the commutator onto the armature shaft, and also, means are provided to maintain the orientation of the commutator as it is placed on the armature shaft.

In the preferred embodiment of this invention, the commutators are oriented to a preset position by using a locator tab so positioned that it extends into a slot between adjacent tangs, and means are employed to impart a rotational component to the commutator to force the tang against the locator tab. Thus, each commutator will be positioned the same way prior to installation.

The mechanism for imparting a rotational component of force to the commutator includes an index pawl movable from a first position clear of the commutator, so that it does not interfere with the loading of the commutator, to a second position where it engages the commutator and tries to rotate it. The index pawl is resiliently mounted so that it may move freely over the commutator once it is properly oriented.

Means are also provided to sense that the commutator is in its proper position for installation. In the preferred embodiment of the invention, a proximity sensor is employed for this purpose. If the commutator is improperly located, it will not seat properly in the loading position, and thus other means can be employed either to reposition it or to signal the machine operator that a malfunction has occurred.

If the commutator does not seat properly on the first try, circuit means are provided to recycle the index pawl thereby to impart first a reverse component of rotation and then a forward component of rotation in an attempt to seat the commutator properly before alerting the operator to the malfunction.

The orientation of the commutator is maintained from the loading position to its final seated position on the shaft by a pair of overhead rails. Since the rails are located above the commutator, they may be fixed and still not interfere in any way with the loading and unloading of the armatures.

These and other objects of the present invention will be apparent from the following description, the accompanying drawings and the appended claims.

DESCRIPTION OF THE PREFERRED EMBODIMENT

Figure 1:
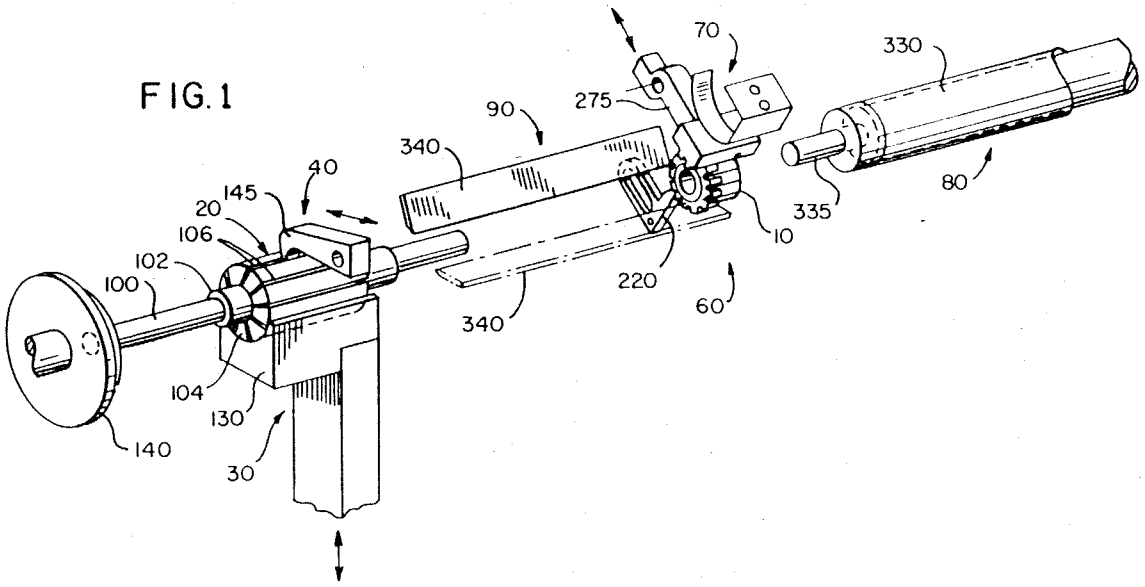
FIG. 1 is a perspective view illustrating the relationship between some of the components that comprise an armature placing machine.

Referring now to the drawings which illustrate a preferred embodiment of the invention, and particularly to FIG. 1, a machine for placing a commutator 10 onto an armature 20 includes means 30 for raising the armature to a place where the commutator can be installed thereon, means 40 for positioning the armature accurately prior to the installation of the commutator, means 50 for feeding commutators one at a time to a loading position 60, means 70 for assuring proper orientation of each commutator prior to installation on the armature shaft, means 80 for installing a commutator on an armature shaft, and means 90 for maintaining the orientation of a commutator from the loading position 60 to its final seated position on the armature shaft.

A typical armature 20 includes a shaft 100, an insulating sleeve 102 and a stack of slotted laminations 104. The copper wire forming the windings of the armature are installed through slots 106 in the laminations, and these windings will be connected to tangs on the commutator 10 once the commutator is installed on the shaft.

A plurality of armatures are supplied on inclined feed tracks 120 where they move one at a time into position 125 defined by a bracket 126.

The means 30 for raising the armature from the position 125 to a place where the commutator can be installed thereon includes a lift chuck 130 having an upper surface 131 formed to receive the lamination stack 104 of the armature, a lift slide 132 connected between the lift chuck, and a pneumatic cylinder 135. The lift slide 132 is guided by guide gibs 137, and this assembly is movable between the lower position shown by solid lines and an upper position shown by dotted lines in FIG. 2.

Figure 2:
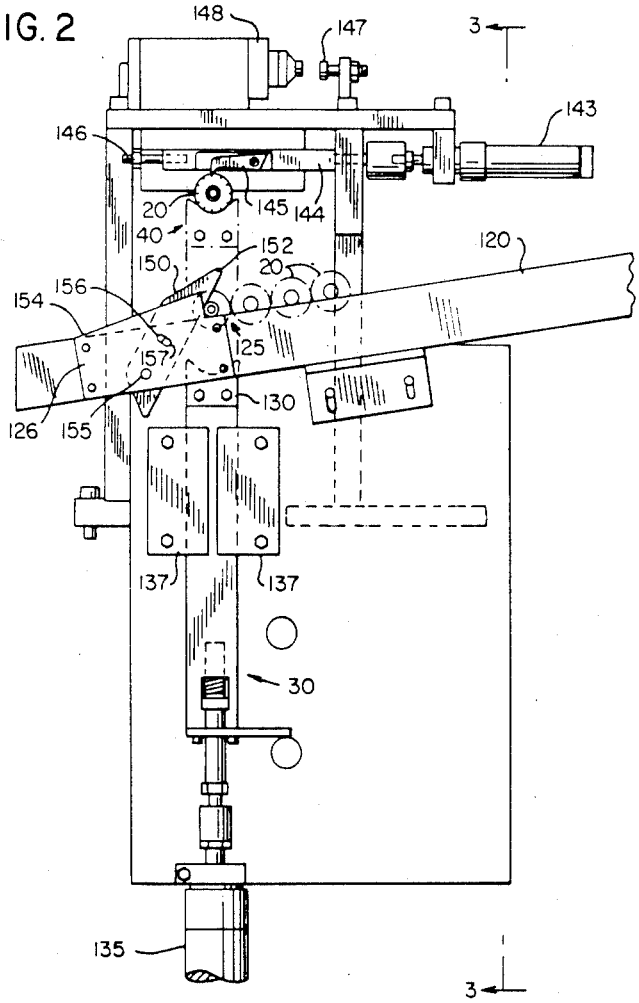
FIG. 2 is a front elevational veiw showing the mechanism for positioning the armatures to receive a commutator.
Figure 3:
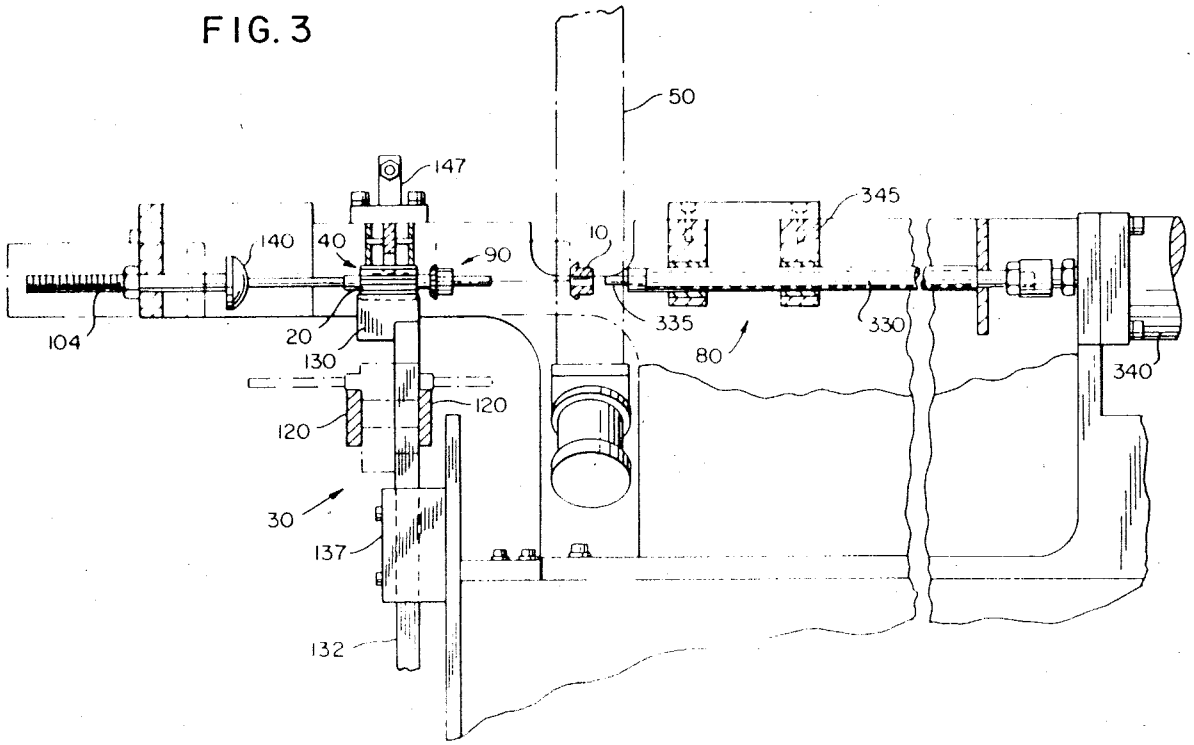
FIG. 3 is a side elevational view showing the armature positioning mechanism and the mechanism for placing a commutator onto the armature shaft.

As each armature is raised to the upper position, as shown by the solid lines in FIG. 3, the left end of the shaft 100 engages the mushroom alignment head 140. The position of this alignment head is adjustable by means of the stop screw 141 and lock nut 142. A pneumatic cylinder 143 then moves index slide 144 to the left, as viewed in FIG. 2, and a dog 145, pivotably mounted on the index slide, engages one of the slots 106 in the armature to rotate the armature into a predetermined position. That position is determined by adjustable stop 146. For control purposes, a switch actuator 147 carried by the index slide engages a switch 148 when the armature is in proper position so that control circuitry associated with this device will permit continuation of the assembly sequence.

After a commutator is installed on the armature shaft in accordance with the procedures later to be described, pressure to the pneumatic cylinder 143 is reversed, and the index slide 144 and dog 145 are moved back away from the armature, and the pressure to pneumatic cylinder 135 is also reversed to cause the lift chuck to lower the armature. As it is lowered, the shaft 100 is picked up by the upper surfaces 150 of stripper fingers 152 where it then rolls to the left, as shown in FIG. 2, onto the ramp portion 154 of the bracket 126 and continues down the feed track 120 to a discharge position. The stripper fingers 152 are each mounted by pivot pin 155 to the tracks 120 and are restrained to move between the position shown in FIG. 2 to a position clear of the armature as the armature is raised to its position, by means of pin 156 in slot 157.

Figure 14:
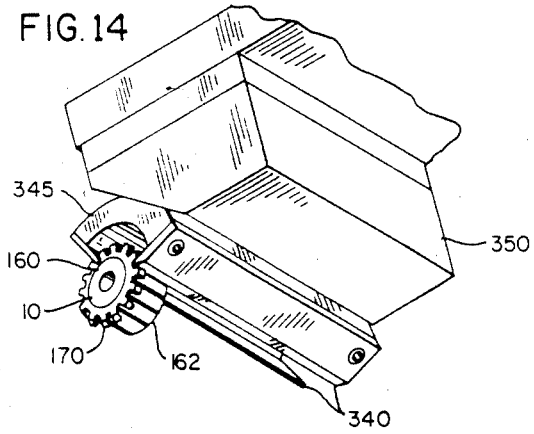
FIG. 14 is a perspective view showing the rails for guiding the commutator onto the armature shaft without rotation.

A typical commutator 10, shown in FIG. 14, includes an insulating base member 160 and a plurality of conductive, usually copper, segments 162, with each segment having associated there with a tang 170 around which a wire from the armature windings is placed to provide electrical contact.

It is the angular position of the commutator segments, as represented by the corresponding tangs, that must be accurately maintained with respect to the angular position of the slots 106 of the armature stack if the armature, and thus the motor into which it is placed, is to operate properly.

Commutators 10 are supplied to the means 50 for feeding commutators with tangs 170 facing toward the armature onto which they are to be loaded.

Figure 4:
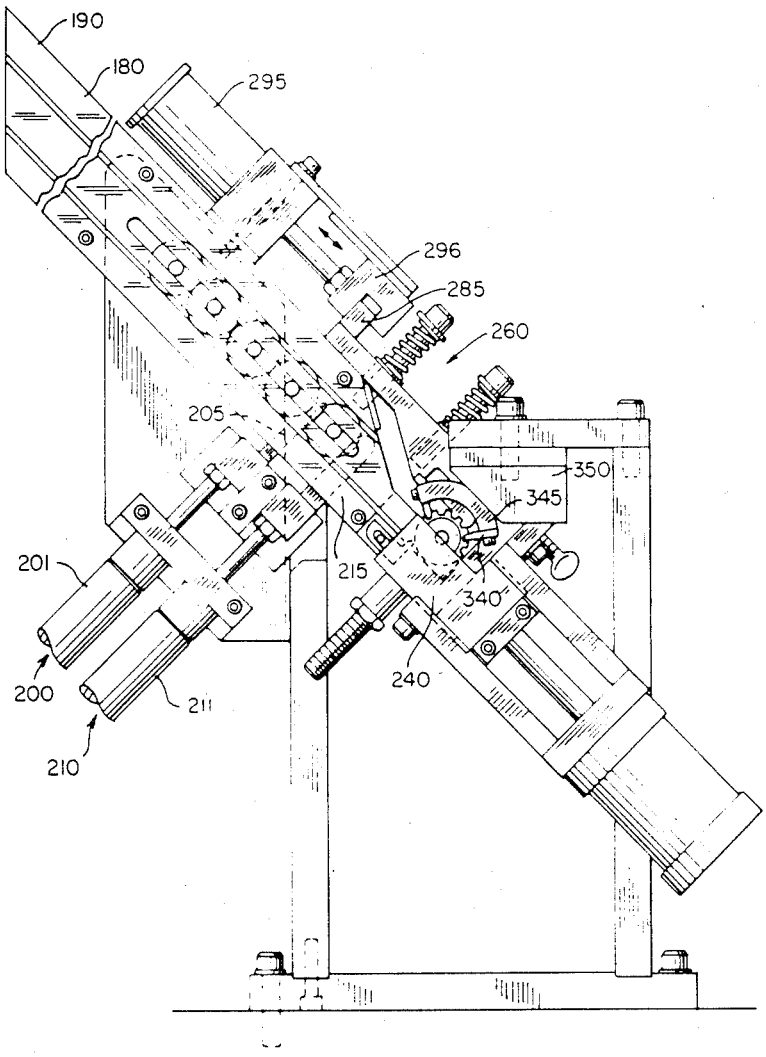
FIG. 4 is a front elevational view of the commutator feeding and orienting apparatus of this invention.
Figure 10:
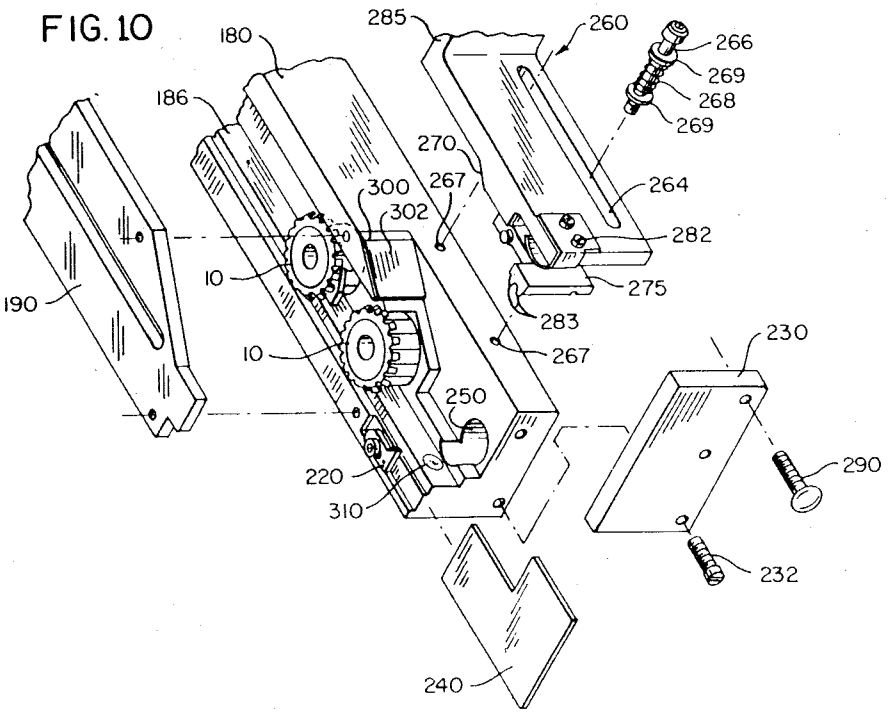
FIG. 10 is a perspective view of the apparatus shown in FIGS. 5–9.
Figure 11:
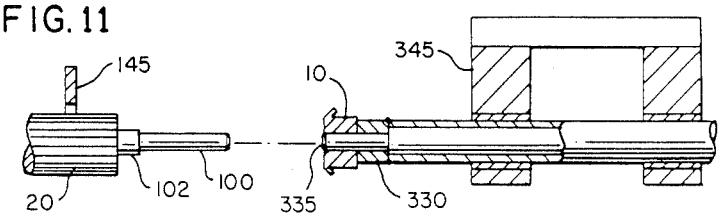
FIGS. 11–13 are elevational views showing the sequence of installing a commutator on an armature shaft.

The commutator feeding means 50 is shown in FIGS. 4 and 10. A commutator shute assembly 180 receives the commutators 10 at the upper end and directs them downwardly toward a loading position shown generally at 185. The shute assembly is provided with a slot 186 that is formed deep enough to accept the body of the commutator. In order to accommodate the tangs 170, the slot is widened near the outer edge thereof. Thus, the commutators may roll freely down the slot 186 while the tangs are essentially free of direct contact with the shute assembly. A commutator shute cover plate 190 may be attached to the outer surface of the shute assembly to retain the commutators in the slot.

The commutators 10 are fed one at a time into the loading position 185 by means of a pair of pneumatically activated stop mechanisms. A front stop mechanism 200 includes a pneumatic cylinder 201 that controls the position of the front commutator stop 205. Similarly, the rear commutator stop mechanism 210 includes a pneumatic cylinder 211 connected to the rear commutator stop 215. The end of front commutator stop 205 extends into the slot 186 and is tapered so that it may easily be inserted between adjacent commutators.

In operation, while the rear commutator stop 215 is extended to hold all of the commutators in the commutator feeding means in the track, the front commutator stop 205 is extended, and then the rear commutator stop is retracted to allow a single commutator to move down the track into the loading position 185.

As the commutators 10 roll down the slot 186 to the loading position 185, the tangs 170 will engage a locator tab 220. The locator tab is placed in the loading position 185 in a slot 222 formed in the lower part of the shute assembly 180. It includes an upwardly extending portion that will establish the final rotational position of the commutator. The locator tab is held in position by a screw 225 extending through slot 226.

An end plate 230 is secured to the lower end of the shute assembly 180 by means of bolts 232. Also shown in FIG. 10 is a commutator shute gate 240 movable between the position shown and to a position in front of a commutator when the commutator is in the loading position 185.

An opening 250 is formed in the back wall of the shute assembly 180 through which the mechanism for installing the commutators onto the armature shaft passes. The opening 250 is coaxial with the commutator when it is in the loading position and properly oriented.

A device for imparting a rotational component of force to the commutators to ensure their proper orientation in the loading position is provided by this invention. This device includes a rotation slide assembly shown generally at 260. This assembly 260 comprises an index slide 262 having a slot 264 extending along the length thereof, and a pair of bolts 266 which extend through the slot into threaded openings 267 in the shute assembly 180. Springs 268 are held between a pair of washers 269 on each bolt to force the index slide 262 into contact with the upper surface of the shute assembly 180.

Figure 9:
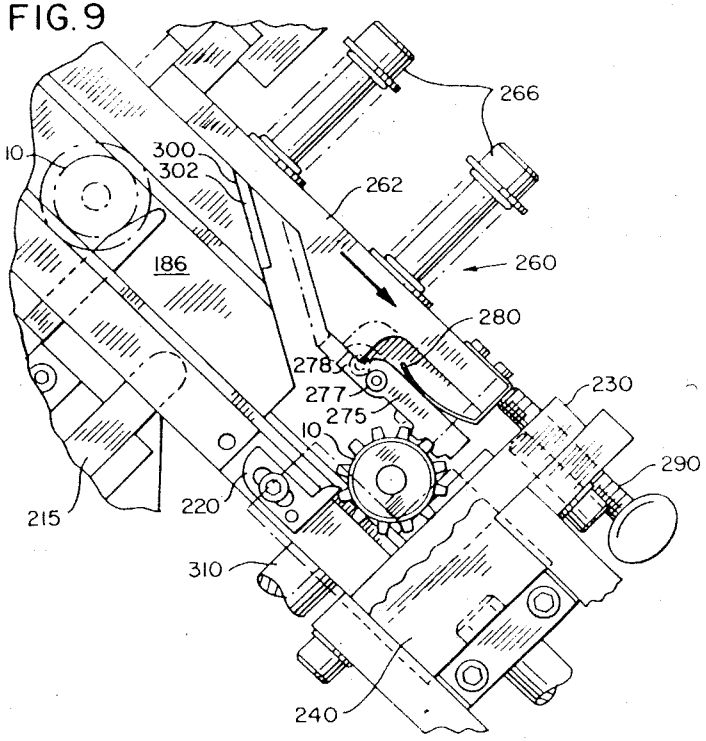

The index slide has a downwardly protruding cam surface 270, and at the lower portion thereof is rotatably mounted a commutator rotation finger or index pawl 275 supported on a pivot pin 277 and restrained from clockwise motion by a rearwardly extending end tab 278. A spring 280 urges the index pawl 275 downwardly so that in normal operation, it is in the position as shown in FIG. 9. The spring 280 is held in position by means of screws 282.

The index pawl 275 includes a pair of downwardly extending teeth 283 for engaging the space between the tangs of a commutator. As shown in these drawings, the teeth are designed to fit between adjacent spaces; however, they could be spaced apart any integral multiple of the spacings of the tangs 170.

The rearward end of the index slide 262 is provided with an upwardly extending boss 285 to which a slide connector is attached to move the slide generally parallel with the shute assembly. Movement of the slide to the right, as viewed in FIG. 9, is limited by means of an adjustable stop 290 formed, in the embodiment of the invention shown, by means of a machine screw extending through a threaded opening in the end plate 230.

The cam surface 270 of the index slide engages sloped surface 300 formed on the shute assembly 180. A slider pad 302 is secured to that surface in order to improve the wear resistance of this assembly. Typically, the shute assembly would be formed from aluminum while the index slide would be machined from steel.

Referring to FIG. 4, a pneumatic cylinder 295 is mounted to the upper surface of the shute assembly 180 for moving the index slide 262. The cylinder is attached to an U-shaped connector 296 which engages the boss 285 to provide means for moving the index slide back and forth along the shute assembly while permitting some vertical movement of the index slide as it moves up and down on the slider pad 300.

FIGS. 5–9 illustrate the sequence of feeding a commutator into a loading position and ensuring that the commutator is properly oriented prior to its installation onto an armature shaft.

Figure 5:
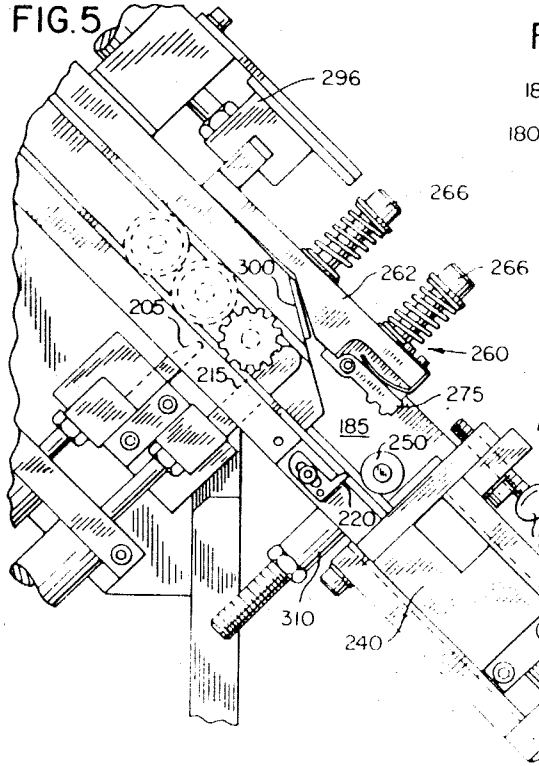

Referring first to FIG. 5, the front commutator stop 205 is shown retracted, and the rear commutator stop 215 is extended. The index slide 262 is in the retracted position, and the commutator shute guard 240 is also shown in the retracted position.

With the index slide 262 in the retracted position, it has engaged the slider pad 302 and has moved upwardly thereon. Therefore, the index pawl 275 is moved to the left and up, and will be clear of any commutator that will be released to move into the loading position 185.

Figure 6:
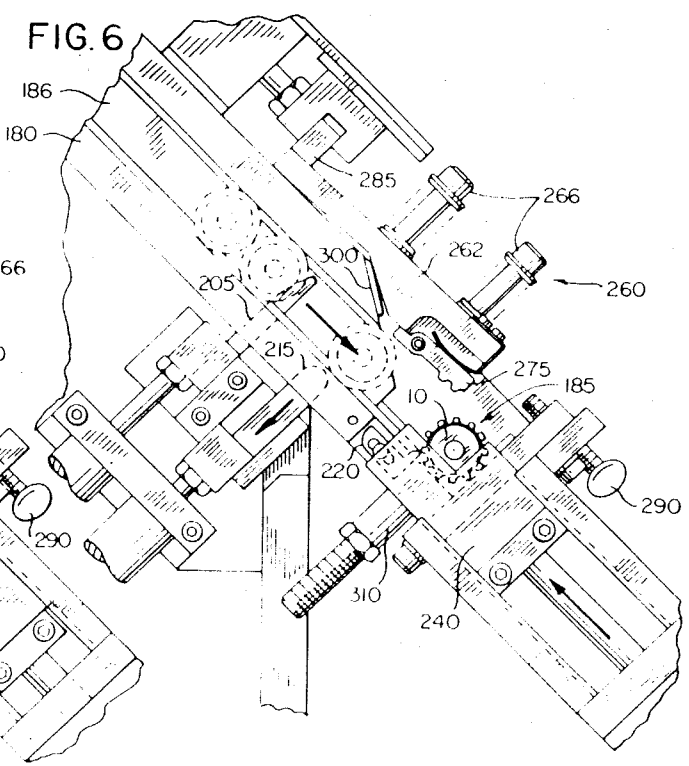
FIGS. 5–9 are detailed elevational views showing the sequence of feeding a commutator into a loading position and ensuring that the commutator is properly oriented prior to installation on an armature shaft.

In FIG. 6, the front commutator stop 205 has been extended, the rear commutator stop 215 has been retracted and a single commutator 10 has moved into the loading position. The commutator shute guard 240 has been extended so that it, along with the commutator shute cover 190, restrains the commutator in its place in the loading position.

As the commutator rolls into the loading position, ideally the locator tab 220 fits in one of the spaces between the tangs, although this will not invariably be true. However, as shown in FIG. 6, this has occured and final orientation of the commutator is now possible.

Figure 7:
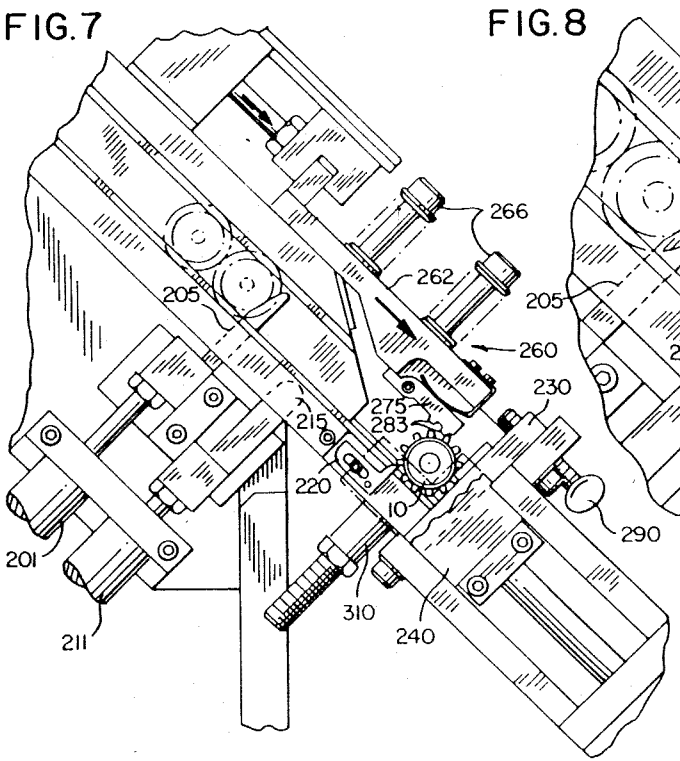

FIG. 7 shows the index slide 262 being moved downwardly and toward the right, and the index pawl 275 begins to engage the upper tangs. The locator tab 220 extends between the tangs, and the commutator 10 rests against the end plate 230, but the commutator is not yet properly oriented.

As the index slide continues to move downwardly and to the right, the teeth 283 on the index pawl will impart to the commutator a rotational component of force and will cause the commutator to rotate until one of the tangs 170 engages the right side of the upwardly extending locator tab 220.

Figure 8:
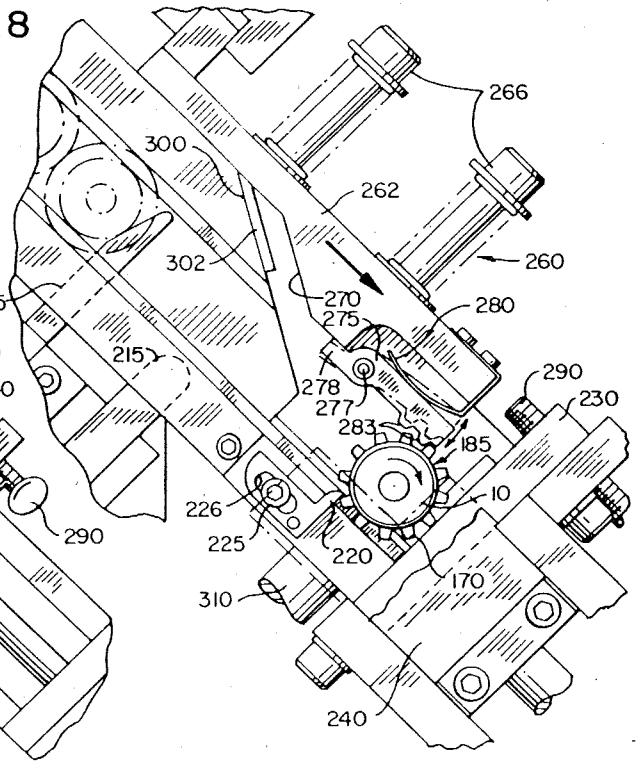

At this point, as shown in FIG. 8, the commutator is properly positioned; however, the index slide has not completed its forward motion. As it continues to move, the teeth 283 of the index pawl 275 will slip over the tangs 170 because the pawl 275 is resiliently mounted on the index slide.

When the index slide reaches its final or second position, as shown in FIG. 9, the teeth on the index pawl will extend into the spaces between adjacent tangs on the commutator, and the commutator will be biased against the location tab. The adjustment screw 290 ensures that the index slide, and thus the index pawl and its teeth, are correlated with the locator tab and the spaces between the tangs on the commutator so it will be in the correct position, and as shown in FIG. 9, and ready to be installed onto the armature shaft.

Means for sensing when the commutator is in the proper position for installation on the armature is provided in the form of a proximity sensor 310. The proximity sensor 310 extends into the slot 186 to ensure that the commutator segments or the body of the commutator is resting on the lower surface of the slot 186 once the index slide has reached its second or final position.

Occasionally, a commutator tang 170 may hang up on top of the locator tab 220, and in spite of the rotational component imparted to the commutator by action of the rotation slide assembly 260, the commutator may not be in a correct position for loading after the above sequence is completed. Under these circumstances, the commutator body would not be in contact with the lower surface of the slide, and this condition would be detected by the proximity sensor 310. Under these circumstances, control circuit means are provided to retract the index slide at least once, and this would impart to the commutator a reverse component of rotation as the slide was moved to the left toward its first position, and then impart a forward component of rotation as the index slide is returned to its second position. This back and forth rotation of the commutator will usually cause it to seat properly. However, if the commutator has not seated properly after a predetermined number of reseating attempts, then operation of the machine would be discontinued, and the operator notified of the malfunction.

The commutator may be installed onto the armature shaft by means 80 illustrated in FIGS. 3 and 11–13. The installing means 80 includes a ram 330, a pilot shaft 335 and a pneumatic actuation cylinder 340. The ram is carried by ram guide blocks 345 provided with suitable bearings.

After the commutator is determined to be in proper position for loading, the ram 330 moves forward, and the pilot shaft 335 extends through the central opening of the commutator. The end of the ram 330 engages the rear surface of the commutator. Of course, the commutator shute gate 240 has been moved clear of the commutator 10.

Figure 12:
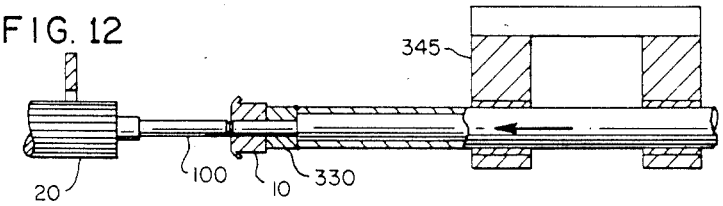
Figure 13:
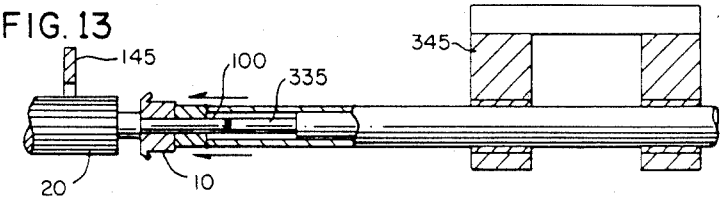

As the ram continues to move to the left, the pilot shaft engages the end of the armature shaft, as shown in FIG. 12, the ram continues to move forward, driving the commutator 10 onto the armature shaft 100, as shown in FIG. 13.

This invention includes means for maintaining the orientation of the commutator from the loading position 185 to its final seated position on the armature shaft, as shown in FIG. 13. As best illustrated in FIGS. 1, 4 and 14, rail means 340 are located above the commutator and in overlapping relationship with the teeth of the index pawl 275. The rail means 340 are oriented to extend into the space between the tangs of the commutator and will prevent the commutator from rotating as it is pressed onto the armature shaft. Locating the guide rails above the commutator and the armature allows the rails to be permanently fixed since they will not interfere with the loading and unloading of the armature.

The rails 340 are mounted on a semicircular block 345, and this block is secured to a guide mount 350 attached to the frame of the machine. The rails extend from just clear of the tangs of the commutator, when it is in the slot 186 of the shute assembly and in the loading position 185, but in overlapping relationship with the teeth of the index pawl, to the final seated position of the commutator on the armature shaft.

Figure 15:
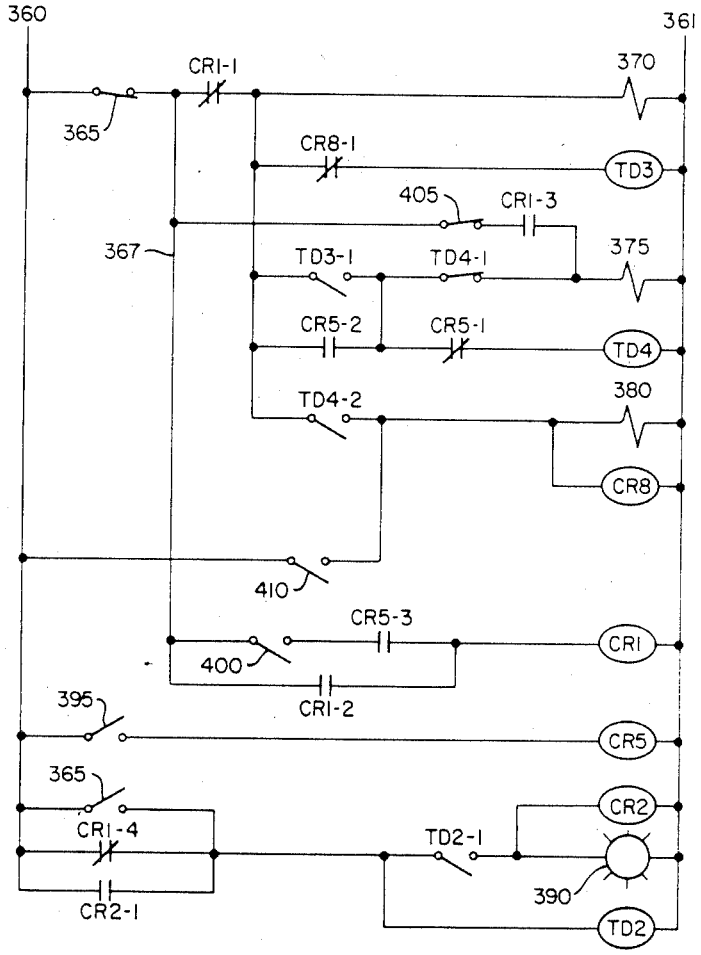
FIG. 15 is an electrical schematic diagram showing a portion of the control circuit used by the present invention.

FIG. 15 is a portion of a control circuit for ensuring that the commutator is properly seated before any attempt is made to install it on the armature shaft, and for causing the index slide to recycle in the event the commutator does not seat properly after the first attempt to position it properly.

The control circuit is provided with electrical current on lines 360 and 361. Although not shown in the drawings, a sensing switch 365 is associated with the ram 330, and when the ram is in the completely retracted position, switch 365 will be closed. This will place power on line 367 and through the normally closed contact CR1-1 to a set of solenoids represented at 370. These solenoids operate the valves that control the front and rear commutator stop pneumatic cylinders 200 and 210, and the commutator shute gate 240.

Power is also applied through CR1-1 and normally closed contacts CR8-1 to a time delay circuit TD3. This circuit provides a 0.2 second time delay, and when that time has expired, its normally open contacts TD3-1 will close and permit current to flow through normally closed contacts TD4-1 to energize solenoid 375. This solenoid controls the valve to pneumatic cylinder 295 and will cause the index slide assembly 260 to begin its movement from the first to the second position.

At the same time, current through contacts TD3-1 will pass through normally closed contact CR5-1 and energize time delay circuit TD4. This is also an approximately 0.2 second time delay circuit; this time is selected to ensure that the index slide reaches its second position before causing it to retract.

Relay CR5 will energize only when a commutator is in its properly seated position by action of the switch LS9 associated with the proximity detector 310. Accordingly, if the commutator is properly positioned, normally closed contact CR5-1 will open, and no current would be applied to the time delay circuit TR4.

On the other hand, if the commutator is not properly seated, then time delay relay TD4 is energized and after approximately 0.2 seconds, contacts TD4-1 will open, removing current from solenoid 375 and, simultaneously, normally open contacts TD4-2 will close and energize solenoid 380 and relay CR8. Solenoid 380 is also associated with the index slide cylinder 295 and will cause the slide assembly 260 to move back toward its first position, thus imparting a reverse component of rotation to the commutator.

At the same time, relay CR8 is energized, its contact CR8-1 will open and remove current from the time delay relay TD3, thus resetting it. Its contacts TD3-1 will open, and current will be removed from the time delay relay TD4, also resetting it. Its contacts TD4-2 will open, and solenoid 380 and relay CR8 will be deenergized. Thus, the circuit is placed back in its original condition.

After 0.2 second delay, contacts TD3-1 will again close, and the cycle will be repeated. Thus, as long as the commutator is not properly seated, the circuit described above will cause the index slide to move back and forth over the top of the commutator.

Current passing through normally closed contact CR1-2 to time delay circuit TD2 will cause that circuit to close its contacts TD2-1 after an approximately two second delay. This will energize relay CR2 and close its normally open contacts CR2-1 and energize the trouble lamp 390. If desired, a normally closed set of contacts of relay CR2 could be inserted in the circuit prior to contacts 365, and thus terminate the operation of the device after the above mentioned two second delay.

Assuming now that the commutator finally is successfully seated in the loading position, the proximity sensor 310 will cause switch 395 to close and energize relay CR5. Its contact CR5-1 will open, and thus remove the power to the time delay relay TD4. Contacts CR5-2 will close, and apply current to the solenoid 375 to ensure that the index slide 260 is and remains fully extended. Contacts CR5-3 will close, and if the index slide is fully extended, as represented by the closure of switch 400, then relay CR1 will energize, and its normally open contacts CR1-2 will close to hold the relay energized. Contact CR1-3 will also close, and current will be supplied through switch 405, which will be closed if the index slide is not extended, to ensure power to solenoid 375.

Other portions of the circuit, not shown, will cause the ram to extend and install the commutator onto the armature shaft. When this occurs, and the ram moves from its retracted position, switch 365 will open and remove current from line 367 and all the components associated therewith. When the ram is extended, limit switch 410 will close, and this will energize relay CR8 and solenoid 380 to cause the index slide to be retracted to its first position preparatory to receiving the next commutator.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A commutator placing apparatus comprising means for directing a commutator into a loading position, means for orienting said commutator including (a) a first, fixed positioning means, (b) a second, movable positioning means, said second positioning means including a commutator index slide movable from a first position to a second position and a commutator index pawl resiliently carried by said index slide and mounted above said commutator, and (c) means for moving said index slide, wherein said index pawl engages the commutator as said index slide is moved from the first position to the second position to impart to the commutator a rotational force to insure that it is properly oriented with respect to said first positioning means.

2. The commutator placing apparatus of claim 1 wherein said index pawl is provided with a plurality of teeth, said teeth being spaced apart an integer multiple of the spacing of said tangs and correlated with the position of said fixed positioning means whereby said teeth are seated between the tangs when the commutator is properly oriented in the loading position.

3. The commutator placing apparatus of claim 1 further including rail means located above the commutator and in overlapping relation with the teeth on said index pawl for directing the commutator onto said armature without rotation, thereby to maintain proper commutator alignment from the loading position to its final seated position on said armature.

4. The commutator placing apparatus of claim 1 including means for sensing when the commutator is in proper position for installation on an armature shaft, and means responsive to said sensing means for causing said movable positioning means to recycle at least once if the commutator is not in proper position for installation on the armature shaft when the index slide reaches its second position.

* * * * *